US009419349B2

(12) United States Patent
Marson et al.

(10) Patent No.: US 9,419,349 B2
(45) Date of Patent: Aug. 16, 2016

(54) COAXIAL CABLE CONNECTOR HAVING A FASTENER AND ANTI-ROTATION PROJECTIONS

(71) Applicant: TYCO ELECTRONICS BRASIL LTDA., Sao Paulo (BR)

(72) Inventors: Joao Antonio Marson, Braganca Paulista (BR); Peterson Pulgrossi, Campinas (BR)

(73) Assignee: TYCO ELECTRONICS BRASIL LTDA., Sao Paulo (BR)

( * ) Notice: Subject to any disclaimer, the term of this patent is extended or adjusted under 35 U.S.C. 154(b) by 0 days.

(21) Appl. No.: 14/511,269

(22) Filed: Oct. 10, 2014

(65) Prior Publication Data

US 2016/0104955 A1 Apr. 14, 2016

(51) Int. Cl.
*H01R 9/05* (2006.01)

(52) U.S. Cl.
CPC ..... *H01R 9/0518* (2013.01); *H01R 9/0521* (2013.01)

(58) Field of Classification Search
CPC ..... H01R 9/0518; H01R 4/307; H01R 11/32
USPC ..... 439/394, 578, 585, 766, 801, 833
See application file for complete search history.

(56) References Cited

U.S. PATENT DOCUMENTS

| | | | | |
|---|---|---|---|---|
| 3,660,805 | A * | 5/1972 | McDonough | H01R 9/0518 174/75 C |
| 5,842,894 | A * | 12/1998 | Mehlberg | H01R 4/304 411/533 |
| 5,931,698 | A * | 8/1999 | Kodama | H01R 9/0527 439/578 |
| 6,280,263 | B1 | 8/2001 | Manor et al. | |
| 6,808,416 | B2 | 10/2004 | Fegley et al. | |
| 7,056,162 | B2 | 6/2006 | Tournier et al. | |
| 7,070,461 | B1 | 7/2006 | Pavlovic et al. | |
| 8,368,613 | B2 | 2/2013 | Hornung | |
| 8,517,778 | B2 | 8/2013 | Fronius | |
| 2011/0136378 | A1 | 6/2011 | Yamakoshi et al. | |

* cited by examiner

*Primary Examiner* — Vanessa Girardi

(57) ABSTRACT

A contact assembly for connecting to a coaxial cable. The contact assembly includes a first conductive member, a second conductive member and an insulator. The first conductive member provides a mechanical and an electrical engagement with a metallic shield of the coaxial cable and provides a mechanical engagement with an insulative jacket of the coaxial cable. The second conductive member provides a mechanical and an electrical engagement with a conductive center core of the coaxial cable. The second conductive member may have a fastening member rotatably attached thereto. The second conductive member may include a first crimp barrel and a second crimp barrel to make the mechanical and the electrical engagement with the coaxial cable. An insulator is positioned and secured between the first conductive member and the second conductive member. The insulator provides electrical isolation between the first conductive member and the second conductive member.

17 Claims, 3 Drawing Sheets

COAXIAL CABLE CONNECTOR HAVING A FASTENER AND ANTI-ROTATION PROJECTIONS

FIELD OF THE INVENTION

The present invention is directed to a contact assembly for use with a coaxial cable. In particular, the invention is directed to a coaxial contact assembly which provides a secure electrical connection and which is easy to install.

BACKGROUND OF THE INVENTION

Electrical connection of an eyelet terminal to a bolt or stud in a vehicle electrical system typically requires manipulation of three pieces: eyelet terminal, nut and tool. The nut is easily dropped, leading to higher scrap cost and possibly impairing the vehicle's function. A shortage of either eyelet terminals or nuts in a sub-assembly can hold up the entire vehicle assembly operation. Attempting to tighten an eyelet terminal on a stud is difficult and awkward since the terminal tends to rotate with the nut and tool, especially if space constraints require a one-handed operation.

One prior art solution to the foregoing problems is the use of an eyelet terminal with a nut rotatably captured over the eyelet. Such captured nut terminals prove useful for low amperage (40-50 amps) applications allowing the use of relatively small gauge wire (e.g. 12 AWG) and thin, easily folded metal blanks for the terminals.

It would, therefore, be beneficial to provide a contact assembly for use with a coaxial cable which is easy to assemble and which minimizes the number of components used during assembly. It would also be beneficial to provide such a contact assembly which can be positioned and fastened at the same time, thereby reducing assembly time.

SUMMARY OF THE INVENTION

An embodiment is directed to a contact assembly for connecting to a coaxial cable. The contact assembly includes a first conductive member, a second conductive member and an insulator. The first conductive member provides a mechanical and an electrical engagement with a metallic shield of the coaxial cable and provides a mechanical engagement with an insulative jacket of the coaxial cable. The second conductive member provides a mechanical and an electrical engagement with a conductive center core of the coaxial cable. The second conductive member has a fastening member rotatably attached thereto. An insulator is positioned and secured between the first conductive member and the second conductive member. The insulator provides electrical isolation between the first conductive member and the second conductive member. In various embodiments, the second conductive member includes a first crimp barrel and a second crimp barrel, with the first crimp barrel provided to make the mechanical and the electrical engagement with the center core of the coaxial cable and the second crimp barrel provided to make the mechanical engagement to a dielectric insulator of the coaxial cable.

An embodiment is directed to a contact assembly for connecting to a coaxial cable. The contact assembly includes a first conductive member, a second conductive member and an insulator. The first conductive member includes first crimping tabs and second crimping tabs. The first crimping tabs are provided to make mechanical engagement with an insulative jacket of the coaxial cable. The second crimping tabs are provided to make mechanical and electrical engagement with a metallic shield of the coaxial cable. The second conductive member includes a first crimp barrel and a second crimp barrel. The first crimp barrel is provided to make a mechanical and an electrical engagement with a center core of the coaxial. The second crimp barrel is provided to make a mechanical engagement to a dielectric insulator of the coaxial cable. The insulator is positioned and secured between the first conductive member and the second conductive member. The insulator provides electrical isolation between the first conductive member and the second conductive member.

An embodiment is directed to a contact assembly for connecting to a coaxial cable. The contact assembly includes a first conductive member, a second conductive member and an insulator. The first conductive member includes first crimping tabs and second crimping tabs. The first crimping tabs are provided to make mechanical connection with an insulative jacket of the coaxial cable. The second crimping tabs are provided to make mechanical and electrical connection with a metallic shield of the coaxial cable. The first conductive member includes anti-rotation projections which are configured to engage and make electrical connection to a mating component. The second conductive member includes a core engaging portion with a first crimp barrel and a second crimp barrel. The first crimp barrel is provided to make a mechanical and an electrical connection with a center core of the coaxial cable. The second crimp barrel is provided to make a mechanical connection to a dielectric insulator of the coaxial cable. The insulator is positioned and secured between the first conductive member and the second conductive member. The insulator provides electrical isolation between the first conductive member and the second conductive member.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
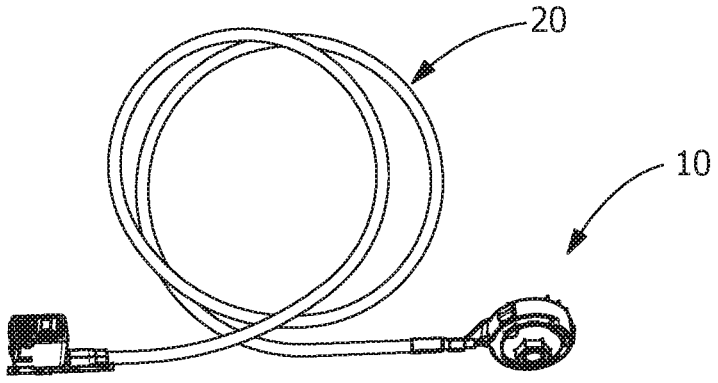
FIG. 1 is a perspective view of an illustrative contact assembly attached to a coaxial cable.

The present invention will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that spatially relative terms, such as "top", "upper", "lower" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "over" other elements or features would then be oriented "under" the other elements or features. Thus, the exemplary term "over" can encompass both an orientation of over and under. The device may be otherwise oriented (rotated 90 degrees or at other orientations) and the spatially relative descriptors used herein interpreted accordingly.

Figure 3:
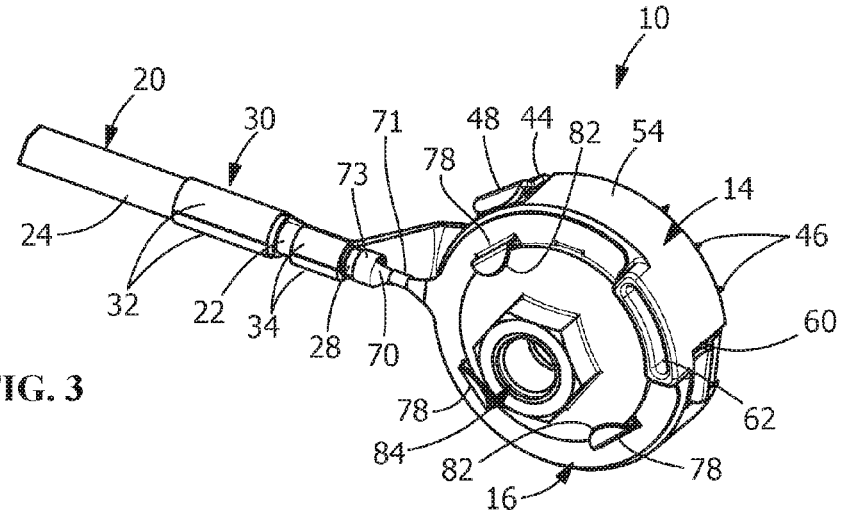
FIG. 3 is a top perspective view of the contact assembly of FIG. 1.
Figure 4:
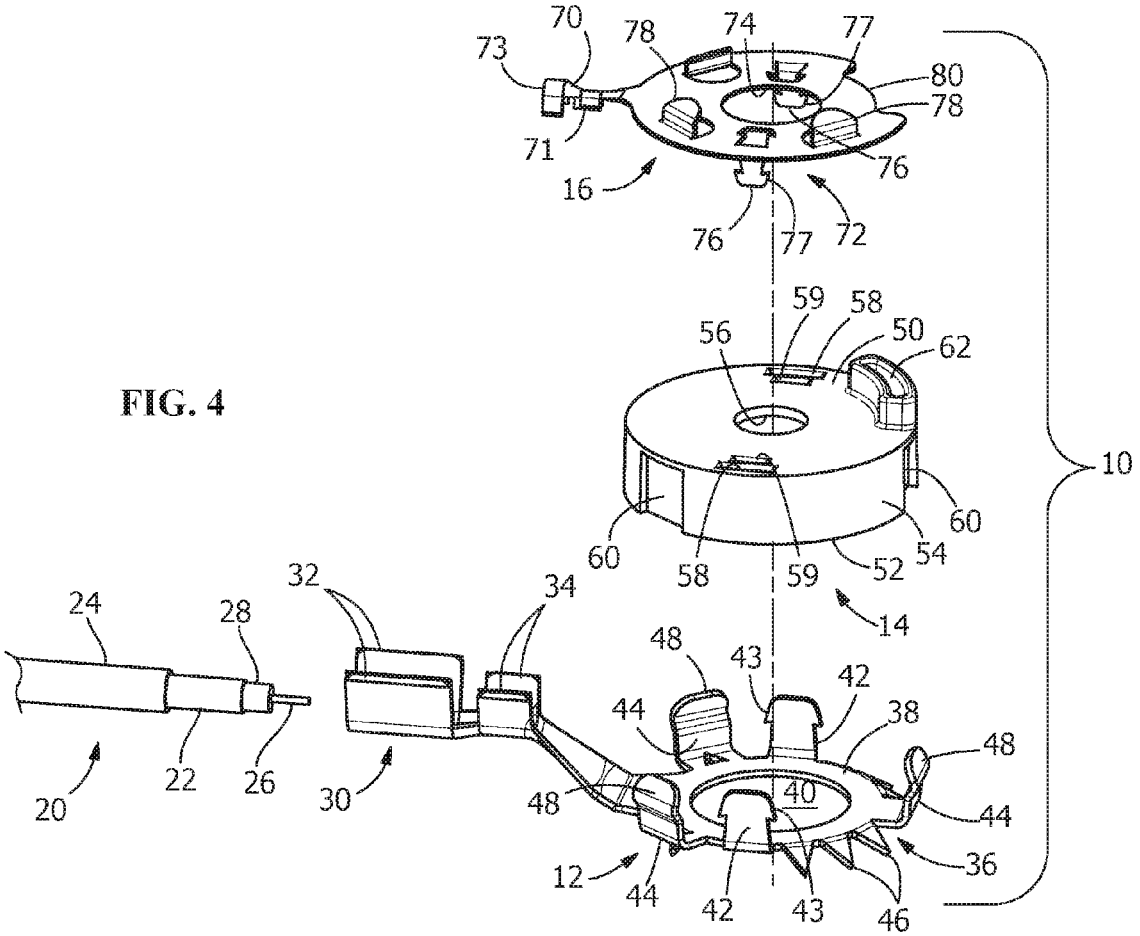
FIG. 4 is a top exploded perspective view of the contact assembly of FIG. 1.
Figure 5:
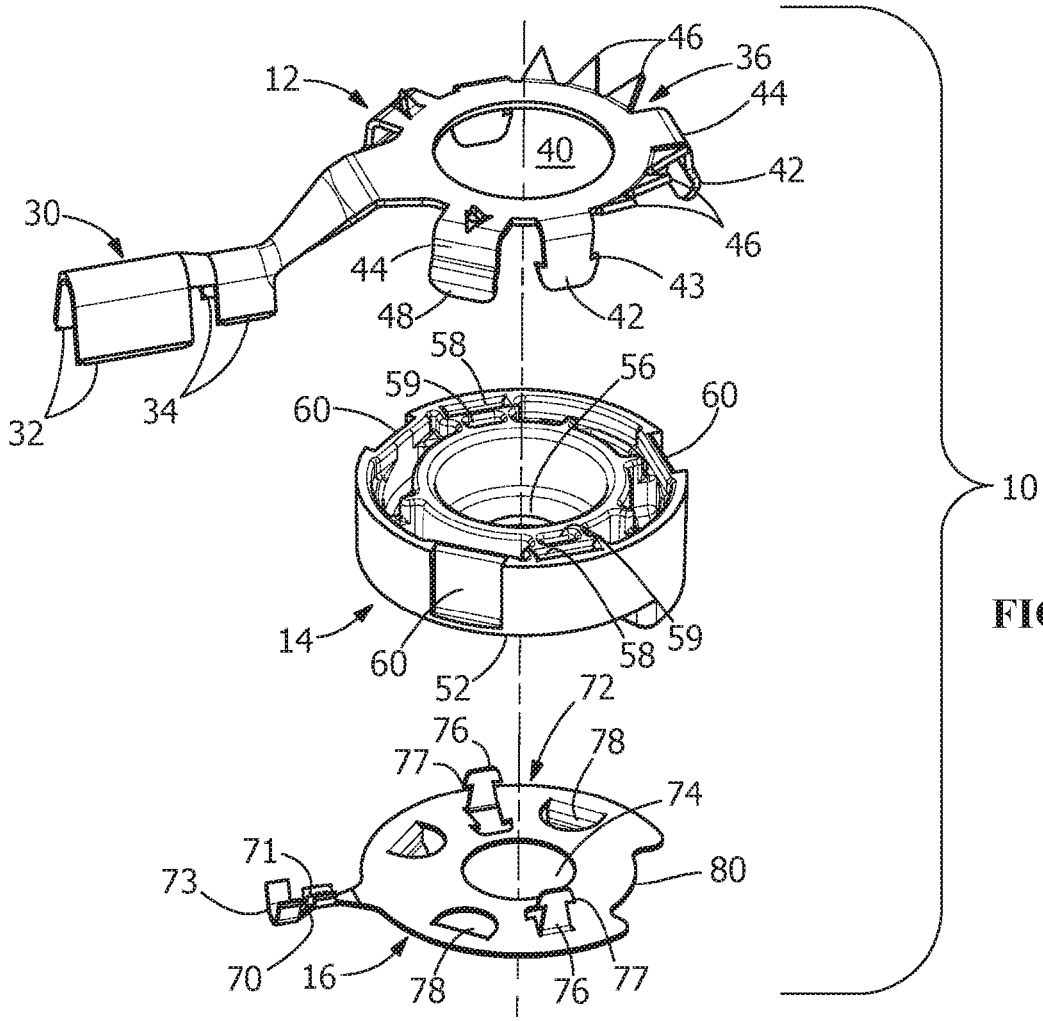
FIG. 5 is a bottom exploded perspective view of the contact assembly of FIG. 1.
Figure 6:
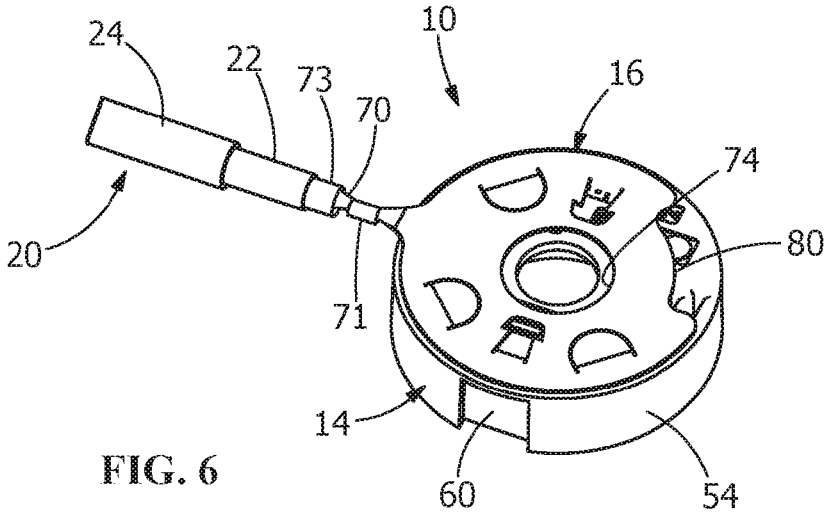
FIG. 6 is a top perspective view of an alternate illustrative contact assembly.

As best shown in FIGS. 4 and 5, a contact assembly 10 according to the present invention includes a first conductive member 12, an insulator 14 and a second conductive member 16. As best shown in FIGS. 3 and 6, the first conductive member 12 is provided in mechanical and electrical engagement with a metallic shield 22 of a coaxial cable 20. The first conductive member 12 is also provided in mechanical engagement with the insulative jacket 24 of the cable 20. The second conductive member 16 is provided in mechanical and electrical engagement with a conductive center core 26 of the cable 20. A dielectric insulator 28 surrounds the core 26 to electrically isolate the core 26 from the shield 22. As coaxial cables 20 are known in the art, a further explanation of the cable 20 will not be provided. The assembly 10 is attachable to any suitable mating component such that the assembly 10 may be electrically connected to the component. For example, the assembly 10 may be attached to a vehicle antenna having a threaded mounting post, or other suitable mounting member.

In the illustrative embodiment shown, the first conductive member 12 and the second conductive member 16 are formed from a flat blank of electrically conductive metal such as copper with a tin plating. Alternatively, the first conductive member 12 and the second conductive member 16 may be made from any materials having the desired conductive and mechanical properties, including, but not limited to, sheet metal, such as spring steel. The insulator 14 is made from any dielectric insulative material, such as plastic, which provides sufficient electrical insulation to electrically isolate the first conductive member 12 from the second conductive member 16.

Figure 2:
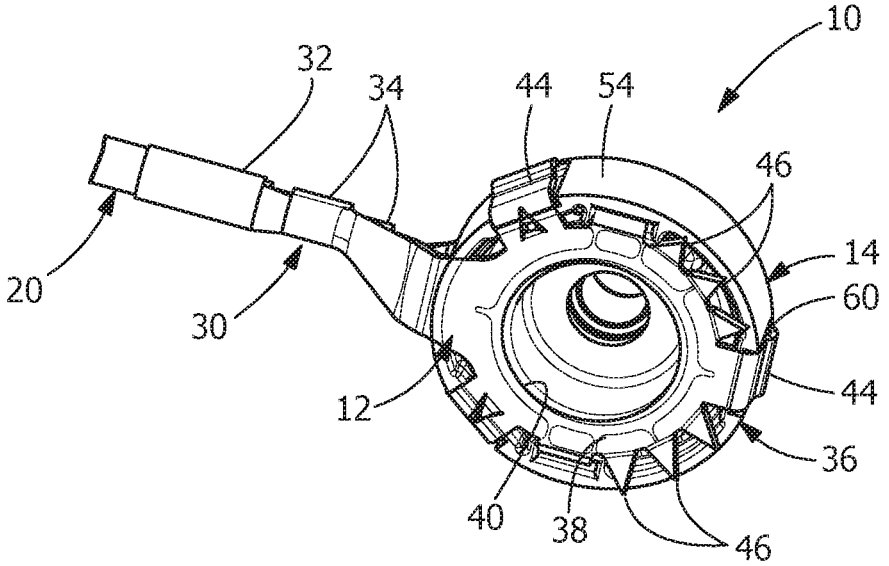
FIG. 2 is a bottom perspective view of the contact assembly of FIG. 1.

As best shown in FIGS. 2, 4 and 5, the first conductive member 12 includes a shield or cable engaging portion 30 for crimping around the stripped end of the cable 20 in conventional manner to form a secure electrical connection. In the illustrative embodiment shown, the cable engaging portion 30 has two sets of crimping tabs. A first set of crimping tabs 32 is typically crimped around the insulative jacket 24 of the cable 20 to provide a mechanical connection and/or engagement between the cable engaging portion 30 and the cable 20. A second set of crimping tabs 34 is crimped onto an exposed portion of the metallic shield 22 to provide the mechanical and electrical connection and/or engagement between the metallic shield 22 and the first conductive member. While the first conductive member 12 is shown as crimped to the cable 20, other methods of termination may be used.

The first conductive member 12 also includes a mating portion 36 which extends from the cable engaging portion 30. The mating portion 36 includes an insulator mounting portion 38 with an opening 40 which is dimensioned to receive a mounting post therein. The mating portion 36 includes insulator location tabs 42, insulator securing tabs 44 and anti-rotation projections 46.

In the illustrative embodiment shown, the insulator location tabs 42 extend from the insulator mounting portion 38 in a direction which is essentially perpendicular to the plane of the insulator mounting portion 38. The insulator location tabs 42 have projection or barbs 43 which extend from free ends thereof. In the illustrative embodiment, two insulator location tabs 42 are provided, however, other numbers of insulator location tabs 42 may be provided in other embodiments.

The insulator securing tabs 44 also extend from the insulator mounting portion 38 in a direction which is essentially perpendicular to the plane of the insulator mounting portion 38. The insulator securing tabs 44 have mounting tabs 48 which extend from the end of the insulator securing tabs 44 which are removed from the insulator mounting portion 38. The mounting tabs 48 are angled and extend inward of the insulator securing tabs 44. The insulator securing tabs 44 can be resiliently displaced when the mating portion 36 is mounted to the insulator 14, as will be more fully described. In the illustrative embodiment, three insulator securing tabs 44 are provided, however, other numbers of insulator securing tabs 44 may be provided in other embodiments.

The anti-rotation projections 46 extend at an angle from the insulator mounting portion 38. The anti-rotation projections 46 extend from the insulator mounting portion 38 in an opposite direction as the insulator securing tabs 44. In the illustrative embodiment, the anti-rotation projections 46 are barbs or cantilevered tooth members which are configured to engage and make electrical connection to the mating component. The anti-rotation projections may have any suitable configuration for engagement with a contact surface or mounting surface of the mating component.

As best shown in FIGS. 4 and 5, the insulator 14 has a generally cylindrical configuration with a first surface 50, a second surface 52 and a side surface 54 which extends between the first surface 50 and the second surface 52. The insulator 14 has an opening 56 which extends from the second surface 52 to the first surface 50. The opening 56 is dimensioned to receive the mounting post therein. Location openings 58, 59 also extend from the second surface 52 to the first surface 50. In the illustrative embodiment, two location openings 58 and two location openings 59 are provided, however, other numbers of location openings 58, 59 may be provided in other embodiments. Recesses 60 are provided along the side surface 54. The recesses 60 are dimensioned to receive the insulator securing tabs 44 therein. In the illustrative embodiment, three recesses 60 are provided, however, other numbers of recesses 60 may be provided in other embodiments.

A positioning member and a nut or fastener holder 62 are provided on the insulator 14. The fastener holder 62 extends from the first surface 50 and is positioned proximate the side surface 54. However, other configurations and numbers of the fastener holder 62 may be used without departing from the scope of the invention. In addition, in various embodiments, the insulator 14 may not have a fastener holder 62 (as shown in FIG. 6).

As best shown in FIGS. 3, 4 and 5, the second conductive member 16 includes a core engaging portion 70. In the illustrative embodiment shown, the core engaging portion 70 has a first crimp barrel 71 which crimps around the stripped end of the center core 26 of the cable 20 to form a secure mechanical and electrical connection and/or engagement between the center core 26 and the second conductive member 16. In addition, the core engagement portions 70 has a second crimp barrel 73 for crimping to the dielectric insulator 28 of the cable 20 to provide a secure mechanical connection and/or engagement between the dielectric insulator 28 and the second conductive member 16. The cooperation of the second conductive member 16 with the dielectric insulator 28 provides additional mechanical structure to support the connection between the first crimp barrel 71 which the stripped end of the center core 26. This provides a more secure and stable electrical connection between the second conductive member 16 and the cable 20 than is obtainable using the welding techniques of the prior art.

The second conductive member 16 also includes a mating portion 72 which extends from the core engaging portion 70. The mating portion 72 includes an opening 74 which is dimensioned to receive and make an electrical engagement with the mounting post therein. The mating portion 72 includes insulator location tabs 76, fastener or nut securing tabs 78 and a positioning member receiving recess 80.

In the illustrative embodiment shown, the insulator location tabs 76 extend from the mating portion 72 in a direction which is essentially perpendicular to the plane of the mating portion 72. The insulator location tabs 76 have projections or barbs 77 which extend from free ends thereof. In the illustrative embodiment, two insulator location tabs 76 are provided, however, other numbers of insulator location tabs 76 may be provided in other embodiments.

The fastener securing tabs 78 also extend from the mating portion 72 in a direction which is essentially perpendicular to the plane of the mating portion 72. The fastener securing tabs 78 extend from the mating portion 72 in an opposite direction as the insulator location tabs 76. The fastener securing tabs 78 have mounting tabs 82 which extend from the end of fastener securing tabs 78 which is removed from the mating portion 72. The mounting tabs 82 extend in a direction which is essentially perpendicular to the plane of the mating portion 72. In the illustrative embodiment, three fastener securing tabs 78 are provided, however, other numbers of fastener securing tabs 78 may be provided in other embodiments.

The fastening member receiving recess 80 is configured to receive the fastener holder 62 therein, allowing the second conductive member 16 to be properly positioned on the first surface 50 of the insulator 14 while allowing the fastener holder 62 to extend from the first surface 50 of the insulator 14 beyond the mating portion 72 of the second conductor member 16. A fastener 84, such as, but not limited to a nut, cooperates with the fastener holder 62, as will be more fully described.

As best shown in FIGS. 2 and 3, when assembled, the insulator location tabs 42 of the first conductive member 12 are inserted into the corresponding location openings 58 of the insulator 14. The interaction of the location tabs 42 and the barbs 43 with the corresponding location openings 58 ensures that the insulator 14 will be properly positioned and secured relative to the first conductive member 12. In this position, opening 40 aligns with opening 56 to allow the mounting post of the mating component to be inserted therethrough.

The first conductive member 12 and the insulator 14 are maintained in position by the cooperation of the insulator securing tabs 44 with the insulator 14. During assembly of the insulator 14 and the first conductive member 12, the recesses 60 of the insulator 14 are aligned with the insulator securing tabs 44. The insulator 14 is then inserted between the insulator securing tabs 44, causing the insulator securing tabs 44 to be resiliently deformed outwardly to allow the insulator 14 to move past the mounting tabs 48 of the insulator securing tabs 44. As the insulator 14 is moved proximate to or in engagement with the mating portion 36 of the first conductive member 12, the insulator 14 is moved past the mounting tabs 48, allowing the insulator securing tabs 44 to resiliently return toward their unstressed position, positioning the insulator securing tabs 44 in the recesses 60 of the insulator 14. As this occurs, the mounting tabs 48 are moved into engagement with the recesses 60, causing the mounting tabs 48 to frictionally engage the recesses 60 to prevent the unwanted removal of the first conductive member 12 from the insulator 14. In addition, the insulator location tabs 42 of the first conductive member 12 are dimensioned to frictionally engage the corresponding location openings 58 of the insulator 14 to help maintain and secure the first conductive member 12 in a position relative to the insulator 14.

As assembly occurs, in embodiments in which the fastener 84 is to be used, the fastener 84 is inserted between the fastener securing tabs 78. In the embodiment shown in FIG. 3, the fastener securing tabs 78 cooperate with three sides of the fastener 84 to temporarily hold the fastener 84 in position relative to the second conductive member 16. In this position, the fastener 84 is maintained proximate the second conductive member 16 by the cooperation of the mounting tabs 82 with the fastener 84.

As assembly occurs, the insulator location tabs 76 of the second conductive member 16 are inserted into the corresponding location openings 58 of the insulator 14. The interaction of the location tabs 76 and the barbs 77 with the corresponding location openings 59 and the positioning of the positioning member 62 in the fastening member receiving recess 80 ensures that the insulator 14 will be properly positioned and secured relative to the second conductive member 16. In this position, opening 74 aligns with opening 56 to allow the mounting post of the mating component to be inserted therethrough. In addition, the insulator location tabs 76 of the second conductive member 16 are dimensioned to frictionally engage the corresponding location openings 58 of the insulator 14 to help maintain the second conductive member 16 in position relative to the insulator 14.

In embodiments in which a fastener 84 is used, the positioning member 62 cooperates with the fastener 84 when the second conductive member 16 is properly secured to the insulator 14. In this fully assembled position, the positioning member 62 and the fastener securing tabs 78 cooperate to prevent the removal of the fastener 84 from the second conductive member 16. However, the fastener 84 is rotatably attached to the second conductive member 16, allowing the fastener 84 to rotate when maintained in this position, thereby allowing the fastener or fastener 84 to be rotated to tighten the fastener 84 and the contact assembly 10 to a threaded mounting post or the like. While the assembly of the illustrative embodiment has been described with reference to the method described above, other methods and assembly steps may be performed without departing from the scope of the invention. In addition, the particular order of the method steps described may be varied.

When fully assembled, the insulator 14 electrically isolates the first conductive member 12 from the second conductive member 16, thereby allowing the second conductive member 16 to conduct signal transmissions while the first conductive member provides shielding. In the illustrative embodiment the assembly uses a 26 AWG gauge wire which is able to accommodate a signal strength of up to 100 mA. However, the invention is not limited to the wire gauge and signal strength of the illustrative embodiment.

While the invention has been described with reference to an illustrative embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments and methods are therefore to be considered in all respects as illustrative and not restrictive, the scope of the invention being defined by the appended claims, and not limited to the foregoing description or embodiments.

The invention claimed is:

1. A contact assembly for connecting to a coaxial cable, the contact assembly comprising;

a first conductive member for making mechanical and electrical engagement with a metallic shield of the coaxial cable and for making mechanical engagement with an insulative jacket of the coaxial cable;

a second conductive member for making a mechanical and an electrical engagement with a conductive center core of the coaxial cable, the second conductive member having a fastener attached thereto;

an insulator positioned and secured between the first conductive member and the second conductive member, the insulator providing electrical isolation between the first conductive member and the second conductive member, the insulator has location openings which extend from a second surface to a first surface.

2. The contact assembly as recited in claim 1, wherein the first conductive member and the second conductive member are attached to the coaxial cable by crimping, the second conductive member having a first crimp barrel and a second crimp barrel, the first crimp barrel provided to make the mechanical and the electrical engagement with the center core of the coaxial cable, the second crimp barrel provided to make the mechanical engagement to a dielectric insulator of the coaxial cable.

3. The contact assembly as recited in claim 1, wherein the insulator has a fastener member which extends from the first surface and is positioned proximate a side surface.

4. The contact assembly as recited in claim 1, wherein the first conductive member includes an insulator mounting portion having insulator location tabs for cooperating with the insulator, insulator securing tabs for cooperating with the insulator and anti-rotation projections.

5. The contact assembly as recited in claim 4, wherein the insulator securing tabs include mounting tabs which extend from the end of the insulator securing tabs, mounting tabs are angled and extend inward of the insulator securing tabs, whereby the insulator securing tabs can be resiliently displaced when the first conductive member is mounted to the insulator.

6. The contact assembly as recited in claim 4, wherein the anti-rotation projections extend at an angle from the insulator mounting portion in an opposite direction as the insulator securing tabs.

7. The contact assembly as recited in claim 6, wherein the anti-rotation projections are barbs or cantilevered tooth members which are configured to engage and make electrical connection to a mating component.

8. The contact assembly as recited in claim 1, wherein the second conductive member includes a mating portion having insulator location tabs, fastener securing tabs and a fastening member receiving recess.

9. The contact assembly as recited in claim 8, wherein the fastening member receiving recess is configured to receive a fastener holder of the insulator therein, allowing the second conductive member to be properly positioned on a first surface of the insulator while allowing the fastener holder to extend from the first surface of the insulator beyond the mating portion of the second conductor member.

10. The contact assembly as recited in claim 8, wherein the fastener member is a nut.

11. The contact assembly as recited in claim 8, wherein the insulator location tabs extend from the mating portion in a direction which is essentially perpendicular to the plane of the mating portion.

12. The contact assembly as recited in claim 11, wherein the fastener securing tabs extend from the a mating portion in a direction which is essentially perpendicular to the plane of the mating portion, the fastener securing tabs extend from the mating portion in an opposite direction as the insulator location tabs.

13. The contact assembly as recited in claim 12, wherein the fastener securing tabs have mounting tabs which extend from the end of fastener securing tabs which is removed from the mating portion.

14. A contact assembly for connecting to a coaxial cable, the contact assembly comprising;

a first conductive member having first crimping tabs and second crimping tabs, the first crimping tabs provided to make mechanical engagement with an insulative jacket of the coaxial cable, and the second crimping tabs provided to make mechanical and electrical engagement with a metallic shield of the coaxial cable;

a second conductive member having a first crimp barrel and a second crimp barrel, the first crimp barrel provided to make a mechanical and an electrical engagement with a center core of the coaxial cable, the second crimp barrel provided to make a mechanical engagement to a dielectric insulator of the coaxial cable, the second conductive member including a mating portion having insulator location tabs, fastener securing tabs and a fastening member receiving recess;

an insulator positioned and secured between the first conductive member and the second conductive member, the insulator providing electrical isolation between the first conductive member and the second conductive member.

15. The contact assembly as recited in claim 14, wherein the first conductive member includes an insulator mounting portion having insulator location tabs for cooperating with the insulator, insulator securing tabs for cooperating with the insulator and anti-rotation projections.

16. The contact assembly as recited in claim 14, wherein the second conductive member includes a fastening member rotatably attached thereto.

17. A contact assembly for connecting to a coaxial cable, the contact assembly comprising;

a first conductive member having a cable engaging portion and a mating portion, the cable engaging portion having first crimping tabs and second crimping tabs, the first crimping tabs provided to make a mechanical connection with an insulative jacket of the coaxial cable, and the second crimping tabs provided to make a mechanical and an electrical connection with a metallic shield of the coaxial cable, the first conductive member having an insulator mounting portion having insulator location tabs for cooperating with the insulator, insulator securing tabs for cooperating with the insulator and anti-rotation projections, the first conductive member having;

a second conductive member having a core engaging portion with a first crimp barrel and a second crimp barrel, the first crimp barrel provided to make a mechanical and an electrical connection with a center core of the coaxial cable, the second crimp barrel provided to make a mechanical connection to a dielectric insulator of the coaxial cable, the second conductive member including a mating portion having insulator location tabs, fastener securing tabs and a fastening member receiving recess;

an insulator positioned and secured between the first conductive member and the second conductive member, the insulator providing electrical isolation between the first conductive member and the second conductive member.

* * * * *